US009727016B2

(12) United States Patent
Kamei

(10) Patent No.: US 9,727,016 B2
(45) Date of Patent: Aug. 8, 2017

(54) IMAGE FORMING APPARATUS, IMAGE FORMING SYSTEM, AND IMAGE FORMING METHOD

(71) Applicant: Konica Minolta, Inc., Tokyo (JP)

(72) Inventor: Syunji Kamei, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/090,684

(22) Filed: Apr. 5, 2016

(65) Prior Publication Data

US 2016/0291517 A1 Oct. 6, 2016

(30) Foreign Application Priority Data

Apr. 6, 2015 (JP) ..... 2015-077609

(51) Int. Cl.
*G03G 15/00* (2006.01)

(52) U.S. Cl.
CPC ..... *G03G 15/556* (2013.01); *G03G 15/6517* (2013.01); *G03G 2215/00569* (2013.01)

(58) Field of Classification Search
CPC ..... G03G 15/556; G03G 15/6517; G03G 15/0844; G03G 2215/00569
USPC ..... 399/27, 257
See application file for complete search history.

(56) References Cited

U.S. PATENT DOCUMENTS

| | | | | |
|---|---|---|---|---|
| 7,844,191 | B2 * | 11/2010 | Endou | G03G 15/0844 399/257 X |
| 2006/0029405 | A1 * | 2/2006 | Tanaka | G03G 15/556 399/27 |
| 2008/0152366 | A1 * | 6/2008 | Endou | G03G 15/556 399/27 |
| 2016/0252864 | A1 * | 9/2016 | Kamihara | G03G 15/556 399/27 |

FOREIGN PATENT DOCUMENTS

| | | | |
|---|---|---|---|
| JP | H11-316490 | A | 11/1999 |
| JP | 2006091538 | A | 4/2006 |
| JP | 2009265491 | A | 11/2009 |
| JP | 2009-282450 | A | 12/2009 |
| JP | 2011100035 | A | 5/2011 |
| JP | 2011-107662 | A | 6/2011 |
| JP | 2015-060196 | A | 3/2015 |

OTHER PUBLICATIONS

Office Action in counterpart Japanese Patent Application No. 2015-077609 issued on Mar. 1, 2017 (14 pages).

* cited by examiner

*Primary Examiner* — Sophia S Chen
(74) *Attorney, Agent, or Firm* — Osha Liang LLP

(57) ABSTRACT

An image forming apparatus that performs printing on continuous paper includes: an image forming unit that forms a toner image on an image carrier; a transfer unit that transfers the toner image on the image carrier to the continuous paper; a cleaning unit that removes toner on a surface of the image carrier downstream of a transfer position; and a control unit that performs toner consumption (Continued)

control to form the toner image on the image carrier, wherein the control unit can perform first control to form a first toner image on the image carrier and transfer the toner image to the continuous paper and second control to form a second toner image on the image carrier and remove toner by the cleaning unit without transferring the toner image to the continuous paper, and can select which of the first control and the second control is operated.

16 Claims, 7 Drawing Sheets

[FIRST PATTERN]

[SECOND PATTERN]

[FIRST PATTERN]

[SECOND PATTERN]

IMAGE FORMING APPARATUS, IMAGE FORMING SYSTEM, AND IMAGE FORMING METHOD

The entire disclosure of Japanese Patent Application No. 2015-077609 filed on Apr. 6, 2015 including description, claims, drawings, and abstract are incorporated herein by reference in its entirety.

FIELD OF THE INVENTION

The present invention relates to an image forming apparatus, an image forming system, and an image forming method by which printing can be performed on continuous paper.

BACKGROUND

An image forming apparatus adapted to print an image on paper by an electrophotographic system sometimes performs image stabilization by rendering a correction image on an image carrier such as an intermediate transfer belt in spacing between sheets of paper. A toner consumption image is an example of the correction image used to discard old toner. There is spacing between sheets of paper when printing is performed on a cut sheet, in which case a toner consuming strip is formed on a belt between sheets of paper as described in JP 2011-100035 A. However, there is no spacing between sheets of paper when printing is performed on continuous paper, in which case a technique of a related art cannot be employed. Accordingly, JP 2006-91538 A proposes a method of forming a toner consuming strip in a margin on both edges of a sheet of paper in its width direction. It is however possible that there is no margin on a sheet of paper depending on image data, in which case the toner consuming strip cannot be formed. Therefore, when printing is performed on continuous paper, the toner consuming strip can be formed after completing a job.

A method of cleaning a toner consuming strip formed on a belt includes transferring the strip to paper and cleaning the strip with a cleaning blade provided on the belt. Hereinafter, the method of transferring the strip to paper will be referred to as forming on paper, and the method of cleaning the strip with the cleaning blade will be referred to as forming on a belt.

Forming on a belt has an advantage of generating no paper waste but has a constraint that the cleaning blade is turned up by friction force exceeding an allowable range when toner is excessively supplied to the blade. Due to this constraint, the amount of toner formed at a time on the belt is limited when forming on a belt, whereby it takes time to form the consuming strip.

On the other hand, forming on paper has an advantage of completing formation of the consuming strip in a short time but paper waste is generated from formation of the consuming strip.

SUMMARY

One or more embodiments of the invention allow a toner image used for toner consumption to be switchably formed on paper or a belt in order to address paper waste being generated and time it takes to form the consuming strip.

An image forming apparatus that performs printing on continuous paper reflecting one aspect of the present invention comprises: an image forming unit that forms a toner image on an image carrier; a transfer unit that transfers the toner image on the image carrier to the continuous paper; a cleaning unit that removes toner on a surface of the image carrier downstream of a transfer position; and a control unit that performs toner consumption control to form the toner image on the image carrier, wherein the control unit can perform, in the toner consumption control, first control to form a first toner image on the image carrier and transfer the toner image to the continuous paper and second control to form a second toner image on the image carrier and remove toner by the cleaning unit without transferring the toner image to the continuous paper, and can select which of the first control and the second control is operated.

According to another aspect of the image forming apparatus, the control unit in the second control forms, on the image carrier, the second toner image in which an amount of toner is restricted more than the first toner image.

According to another aspect of the image forming apparatus, the control unit selects the first control when there exists a next job to be performed sequentially, and selects the second control when there exists no next job to be performed sequentially.

According to another aspect of the image forming apparatus, when there exists a next job with no predetermined time interval provided until the start of the next job, the control unit performs the next job before performing toner consumption.

According to another aspect of the image forming apparatus, when there exists a next job with a predetermined time interval provided until the start of the next job, the control unit selects the first control as needed and performs toner consumption before performing the next job.

According to another aspect of the image forming apparatus, when there exists a next job to be performed sequentially with no need to perform toner consumption, the control unit analyzes the next job and, when the toner consumption is required while the next job is being performed, performs the toner consumption by the first control before performing the next job.

According to another aspect of the image forming apparatus, when paper runs out while toner consumption is being performed by the first control, the control unit switches control to the second control and continues the toner consumption control.

According to another aspect of the image forming apparatus, when a next job that can be performed is generated while toner consumption is being performed by the second control, the control unit switches control to the first control and continues the toner consumption control.

According to another aspect of the image forming apparatus, the image forming apparatus further comprises an operation display section that receives operational input, and the control unit receives an instruction of a user through the operation display section and selects either the first control or the second control in the toner consumption control.

According to another aspect of the image forming apparatus, the control unit determines whether or not toner consumption needs to be performed on the basis of a state of toner consumption and, when determining that the toner consumption is needed, performs the toner consumption control by the first control or the second control.

According to another aspect of the image forming apparatus, when there exists a next job, the control unit determines whether or not toner consumption needs to be performed on the basis of the nature of the next job and performs the toner consumption by the first control when determining that the toner consumption is needed.

According to another aspect of the image forming apparatus, the cleaning unit includes a mechanism that removes toner with a blade pressed against the image carrier.

According to another aspect of the image forming apparatus, the image carrier is one or both of an intermediate transfer unit and a photoreceptor.

According to another aspect of the image forming apparatus, the control unit performs the toner consumption while a job is not being performed.

An image forming system reflecting one aspect of the present invention comprises an image forming apparatus that performs printing on continuous paper and include a control unit that performs toner consumption control to form a toner image on an image carrier included in the image forming apparatus, wherein the control unit can perform, in the toner consumption control, first control to form a first toner image on the image carrier and transfer the toner image to the continuous paper and second control to form a second toner image on the image carrier and remove toner by a cleaning unit that removes toner on a surface of the image carrier without transferring the toner image to the continuous paper, and can select which of the first control and the second control is operated.

According to another aspect of the image forming system, the image forming system comprises an image forming apparatus that performs printing on continuous paper and includes: an image forming unit that forms a toner image on an image carrier; a transfer unit that transfers the toner image on the image carrier to the continuous paper; and a cleaning unit that removes toner on a surface of the image carrier downstream of a transfer position.

An image forming method that forms an image on continuous paper reflecting one aspect of the present invention comprises: a process of performing toner consumption in which a toner image is formed on an image carrier; and a selection process of selecting and operating either a first control process of forming a first toner image on the image carrier and transferring the toner image to the continuous paper, or a second control process of forming a second toner image on the image carrier and removing toner by a cleaning unit without transferring the toner image to the continuous paper, wherein the first control process and the second control process can be performed in the process of performing toner consumption.

According to another aspect of the image forming method, the image forming method comprises: an image forming process of forming a toner image on an image carrier; a transfer process of transferring the toner image on the image carrier to the continuous paper; and a cleaning process of removing toner on a surface of the image carrier downstream of a transfer position.

BRIEF DESCRIPTION OF THE DRAWINGS

Embodiments of the invention will become more fully understood from the detailed description given hereinbelow and the appended drawings which are given by way of illustration only, and thus are not intended as a definition of the limits of the present invention, and wherein.

DETAILED DESCRIPTION

Hereinafter, embodiments of the present invention will be described with reference to the drawings. However, the scope of the invention is not limited to the illustrated examples.

Figure 1:
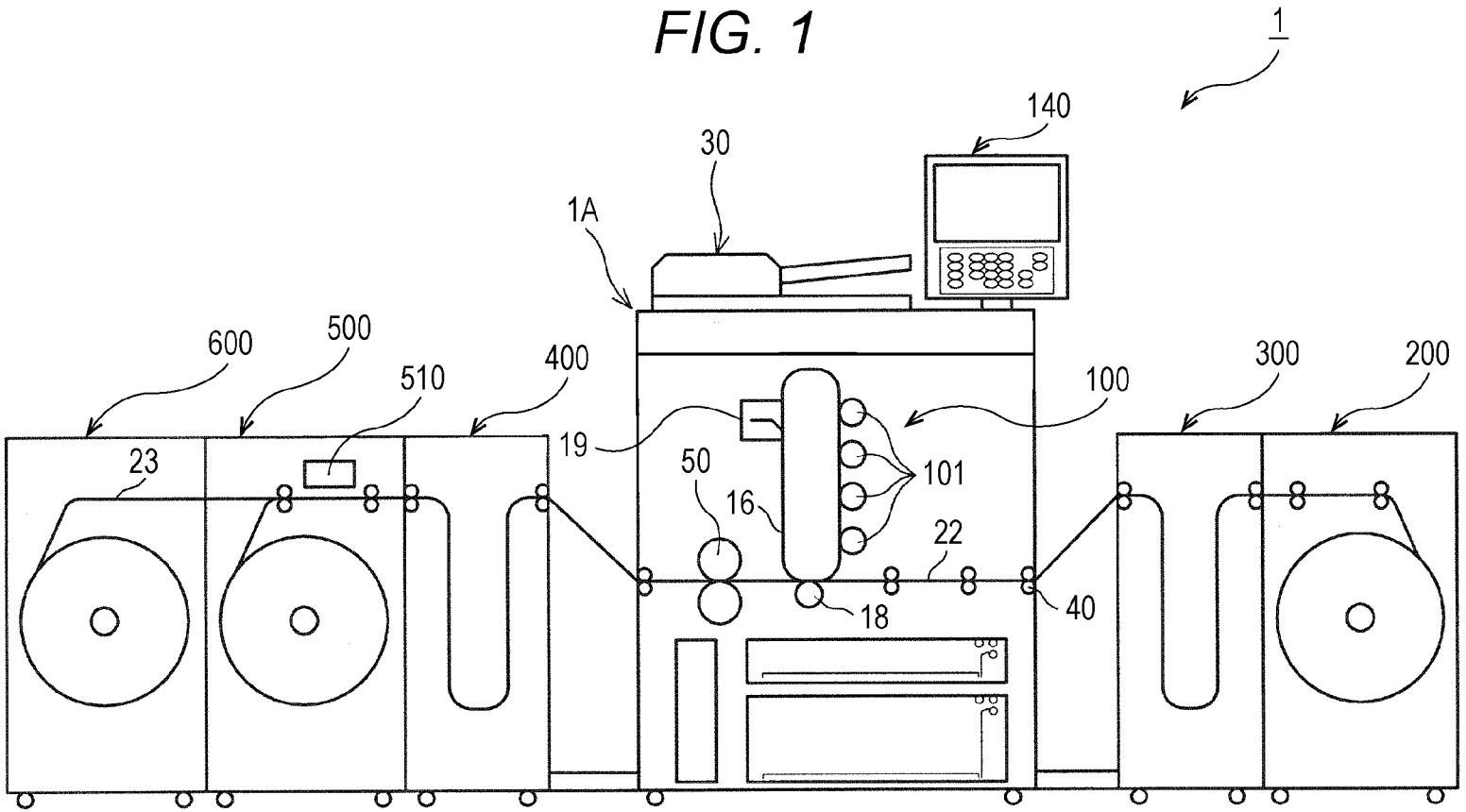
FIG. 1 is a general view illustrating an image forming apparatus according to an embodiment of the present invention.

First, a mechanical configuration according to one or more embodiments of the present invention will be briefly described with reference to FIG. 1.

An image forming apparatus 1 includes an apparatus body 1A, a paper feed adjustment unit 300 is connected upstream of the apparatus body 1A, and a paper feed unit 200 feeding continuous paper is connected upstream of the paper feed adjustment unit 300. Moreover, a paper ejection adjustment unit 400 is connected to a paper ejecting side of the apparatus body 1A, a paper ejection unit 500 is connected to a paper ejecting side of the paper ejection adjustment unit 400, and a mount ejection unit 600 is connected downstream of the paper ejection unit 500.

Note that while the image forming apparatus 1 includes the apparatus body 1A and the units connected to the apparatus body 1A, the type and number of units connected to the apparatus body 1A is not particularly limited as well as the image forming apparatus may include only the apparatus body 1A. In such case, an image forming system is configured together with another unit.

The paper feed unit 200 has a function of storing, keeping and feeding roll paper used as the continuous paper. The paper feed adjustment unit 300 has a buffer function that smooths out a subtle speed difference and offset between the paper feed unit 200 and the apparatus body 1A. The paper ejection adjustment unit 400 has a buffer function that smooths out a subtle speed difference and offset between the paper ejection unit 500 and the apparatus body 1A. The paper ejection unit 500 includes a cutter 510 with a mechanism of cutting out an outline of a label image on the roll paper being conveyed. The cutter 510 can be operated in synchronization with a cycle of the label image. The paper ejection unit 500 further has a function of keeping the roll paper being cut out. The mount ejection unit 600 includes a mechanism of keeping a mount that remains after an image is cut out by the cutter 510.

Note that while the roll paper is used as the continuous paper, the continuous paper is not limited to the roll paper but may be any paper that is continuous including continuous slip paper and continuous form paper. The continuous paper may be provided in the form of the roll paper or fanfold paper.

The image forming apparatus 1 includes within the apparatus body 1A an image forming unit 100 that forms an image on paper. The image forming unit 100 corresponds to an image forming unit of the present invention. An operation display section 140 that accepts an operation by an operator and displays information is provided at the top of the apparatus body 1A. The operation display section 140 may include an operation unit performing an operation separately from a display unit performing display, or include the operation unit and the display unit in one unit such as a touch panel LCD.

Moreover, a document reading unit 30 including an automatic document feeder that automatically reads a document is provided at the top of the apparatus body 1A of the image forming apparatus 1, where an image on a document is read by the document reading unit 30 and temporarily recorded in an image memory not shown. The image being read is used in image formation performed by the image forming unit 100.

The image forming unit 100 includes a photoreceptor 101 provided for each color (including cyan, magenta, yellow and black), and a charging unit, a write unit and a developing unit that are not shown are arranged along the circumference of each photoreceptor 101. A surface of the photoreceptor 101 charged by the charging unit is subjected to image exposure by the write unit such as an LD on the basis of image information on a document recorded in the image memory or the like, whereby a latent image is formed on the surface of the photoreceptor 101. The latent image is developed by the developing unit to be a toner image. The toner image is transferred onto an intermediate transfer belt 16 so that an image on the intermediate transfer belt 16 is conveyed through a conveyance path 22 and transferred to paper conveyed while being pressured by a secondary transfer roller 18. Each of the photoreceptor 101 and the intermediate transfer belt 16 corresponds to an image carrier of the present invention. The secondary transfer roller 18 corresponds to a transfer unit of the present invention.

Note that while a color image forming apparatus is described in one or more embodiments, the apparatus may also be a black-and-white image forming apparatus. In such case, a photoreceptor is included as an image carrier.

The image forming unit 100 is provided with a cleaning blade (not shown) that comes into contact with each photoreceptor to remove residual toner at a position corresponding to each photoreceptor 101 and forward of a position in contact with the intermediate transfer belt 16 in a rotational direction and backward of the charging unit in the rotational direction. Moreover, a cleaning blade 19 that is pressed against the intermediate transfer belt 16 to remove residual toner on the intermediate transfer belt 16 is arranged forward of a paper transfer position of the intermediate transfer belt 16 in the rotational direction and backward of a transfer position with each photoreceptor 101 in the rotational direction. The cleaning blade 19 corresponds to a cleaning unit of the present invention. A configuration of the cleaning unit of the present invention is not limited to the cleaning blade.

Note that each photoreceptor described above is rotationally driven by a drive motor not shown, and so is the intermediate transfer belt 16 rotationally driven by a drive motor not shown.

The image forming apparatus 1 includes the conveyance path 22 provided through the paper feed unit 200, the paper feed adjustment unit 300 to the image forming unit 100, and through the image forming unit 100 to the paper ejection adjustment unit 400.

The conveyance path 22 feeds and conveys paper. The roll paper accommodated in each paper feed unit 200 is fed through the conveyance path 22, passes through a conveyance roller 40 or the like and is conveyed to the secondary transfer roller 18.

While being conveyed by a fixing unit 50, the paper onto which the image is transferred is subjected to application of heat and pressure to fix a toner image on the paper, and then the paper is ejected face up in a single-sided mode to the outside of the apparatus.

Moreover, the image forming apparatus 1 includes a conveyance path 23 provided through the paper ejection adjustment unit 400 to the paper ejection unit 500 and through the paper ejection unit 500 to the mount ejection unit 600. The paper ejection adjustment unit 400 has a buffer mechanism that smooths out a subtle speed difference and offset of the roll paper between the apparatus body 1A and the paper ejection unit 500. In other words, the paper feed adjustment unit 300 and the paper ejection adjustment unit 400 configure a buffer mechanism that smooths out a subtle speed difference and offset of the roll paper between the paper feed unit 200 and the paper ejection unit 500.

Figure 2:
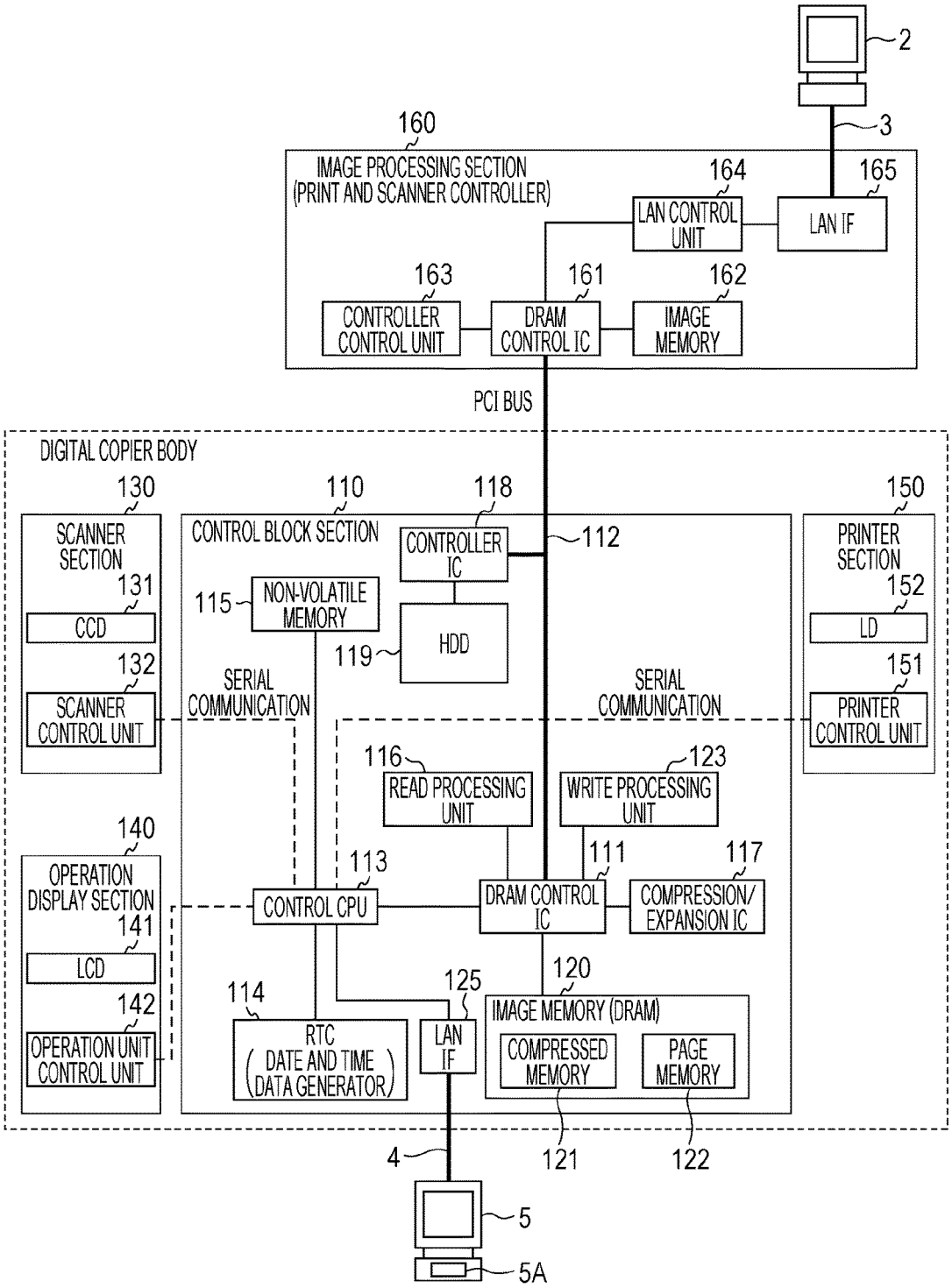
FIG. 2 is a diagram illustrating a control block of the image forming apparatus according to an embodiment of the present invention.

Next, the image forming apparatus 1 will be described in terms of its function on the basis of a block diagram illustrated in FIG. 2.

The image forming apparatus 1 includes as a main configuration a copier body including a control block section 110, a scanner section 130, the operation display section 140 and a printer section 150, as well as an image processing section (print and scanner controller) 160 that processes image data input/output to/from an external apparatus (such as a terminal (PC) 2) through a LAN.

The control block section 110 includes a PCI bus 112, which is connected to a DRAM control IC 111 within the control block section 110. The PCI bus 112 is further connected to an HDD 119 through a controller IC 118. The HDD 119 can store image data and image data used for toner consumption.

The control block section 110 also includes a control CPU 113 which is connected to the DRAM control IC 111. The control CPU 113 is also connected to a non-volatile memory 115. The non-volatile memory 115 stores a program used to operate the control CPU 113, setting data of the image forming apparatus 1, a process control parameter, the image data used for toner consumption, a condition for performing toner consumption, a selection condition for whether toner consumption is to be performed on paper or a belt, and the like.

The control CPU 113 controls the entire image forming apparatus 1 and grasp a condition of the entire image forming apparatus, and performs control such as image formation control and toner consumption control. In other words, the control CPU 113 functions as a part of a control unit of the present invention.

The control CPU 113 is connected to an RTC (date and time data generator) 114, which can transmit date and time data to the control CPU 113.

The scanner section 130 includes a CCD 131 performing optical reading and a scanner control unit 132 controlling the entire scanner section 130. The scanner control unit 132 is connected to the control CPU 113 to be able to perform serial communication therewith, and receives control from the control CPU 113. Note that the scanner control unit 132 can be formed of a CPU and a program operating it. Image data read by the CCD 131 is subjected to data processing in a read processing unit 116.

The operation display section 140 includes a touch panel LCD 141 and an operation unit control unit 142, where the LCD 141 and the operation unit control unit 142 are connected to each other while the operation unit control unit 142 and the control CPU 113 are connected to be able to perform serial communication with each other. Such configuration allows the control CPU 113 to control the operation display section 140. Note that the operation unit control unit 142 can be formed of a CPU and a program operating it.

The operation display section 140 controlled by the control CPU 113 is adapted to allow one to input thereto a setting of the image forming apparatus and an operation control condition such as an operation command as well as to display settings, a machine state and information. A predetermined operation can be performed with use of the operation display section 140. The selection performed by the control CPU 113 to determine whether a toner consuming strip is formed on paper or a belt can be performed manually or can be input as setting data, for example.

The DRAM control IC 111 is connected to an image memory 120 including a compressed memory 121 and a page memory 122. The image memory 120 stores the image data acquired by the scanner section 130 and image data acquired through a LAN 3. The image memory 120 thus serves as a storage area for image data and stores image data of a job to be printed. The DRAM control IC 111 can also cause the image memory 120 to store image data of a plurality of jobs. That is, the image memory 120 can store image data of a reserved job. Image data can also be stored in the HDD 119.

The DRAM control IC 111 is connected to a compression/expansion IC 117 that compresses or expands compressed image data. The DRAM control IC 111 is also connected to a write processing unit 123. The write processing unit 123 is connected to an LD 152 of the printer section 150 and processes data used in an operation of the LD 152. Moreover, the printer section 150 includes a printer control unit 151 that controls the entire printer section 150 while being connected to the control CPU 113 and controlled thereby. That is, a print operation is started/stopped according to a parameter given by the control CPU 113.

A DRAM control IC 161 of the image processing section (print and scanner controller) 160 is connected to the PCI bus 112 that is connected to the DRAM control IC 111. An image memory 162 is connected to the DRAM control IC 161 in the image processing section (print and scanner controller) 160. Moreover, the DRAM control IC 161 in the image processing section (print and scanner controller) 160 is connected to a controller control unit 163 as well as a LAN control unit 164 and a LAN interface 165. The LAN interface 165 is connected to the LAN 3.

The LAN 3 is connected to the terminal (PC) 2 or the like that can transmit/receive image data to/from the image forming apparatus 1.

Moreover, the control CPU 113 is connected to a LAN interface 125 which is connected to a LAN 4. The LAN 4 is connected to a management device 5 directly or through another network. The management device 5 includes a management control unit 5A, an operation of which can manage the image forming apparatus 1. The management control unit 5A can be formed of a CPU, a program operating it and a storage. The management control unit 5A may be adapted to be able to control toner consumption in the image forming apparatus 1, in which case it can be selected whether toner consumption is performed on paper or a belt. When adapted to perform such operation, the management control unit 5A corresponds to the control unit of the present invention. The management device 5 can make up the image forming system controlling the image forming apparatus 1 or may make up the image forming system together with the image forming apparatus 1.

Next, a basic operation of the image forming apparatus 1 will be described.

A procedure of accumulating image data in the image forming apparatus 1 will be described first. When an image on a document is read by the scanner section 130 to generate image data, the image on the document is optically read by the CCD 131 of the scanner section 130. At this time, the operation of the CCD 131 is controlled by the scanner control unit 132 receiving a command from the control CPU 113. The image read by the CCD 131 is subjected to data processing in the read processing unit 116, and then the image data obtained by the data processing is compressed by a predetermined method in the compression/expansion IC 117 to be stored in the compressed memory 121 or the HDD 119 through the DRAM control IC 111. The image data stored in the compressed memory 121 or the HDD 119 can be managed as a job by the control CPU 113.

On the other hand, image data acquired from outside such as the terminal (PC) 2 through the LAN 3 passes through the LAN interface 165 and the LAN control unit 164 to be stored in the image memory 162 by the DRAM control IC 161. Data in the image memory 162 passes through the DRAM control IC 161, the PCI bus 112, and the DRAM control IC 111 to be temporarily stored in the page memory 122. The data stored in the page memory 122 is sequentially transmitted to the compression/expansion IC 117 through the DRAM control IC 111 to be compressed, then stored in the compressed memory 121 or the HDD 119 through the DRAM control IC 111 and managed by the control CPU 113 as described above.

When an image is output from the image forming apparatus 1, namely when the apparatus is used as a copier or printer, the image data stored in the compressed memory 121 or the HDD 119 is sent out to the compression/expansion IC 117 through the DRAM control IC 111 to be subjected to data expansion, so that the expanded data is sent out to the write processing unit 123 to perform writing on each photoreceptor in the LD 152.

Moreover, in the printer section 150, the printer control unit 151 receiving a command from the control CPU 113 performs control on each unit. In the image forming unit 100, a toner image drawn on each photoreceptor is transferred onto the intermediate transfer belt 16 and to the roll paper fed by the paper feed unit 200, and then fixed by the fixing unit 50. A sheet of paper on which the image is formed is conveyed along the conveyance path 23 through a fixing/conveyance roller to the paper ejection adjustment unit 400, and is subjected to post processing in the paper ejection unit 500 provided on a downstream side. When a plurality of jobs is reserved, the image output is performed sequentially according to a set order. A mount of the roll paper after subjected to the processing in the paper ejection unit 500 is rolled up by the mount ejection unit 600.

Moreover, residual toner on each photoreceptor 101 is removed by its cleaning unit after the toner image is transferred onto the intermediate transfer belt 16. Likewise, residual toner on the intermediate transfer belt 16 is removed by the cleaning blade 19 after the toner image is transferred to paper.

In performing toner consumption control, the control CPU 113 reads image data used for toner consumption from the non-volatile memory 115 or the HDD 119 and forms a predetermined toner image in the image forming unit 100. At this time, the data is transferred to the image memory 120 and expanded in the compression/expansion IC 117 as needed to form write data in the write processing unit 123.

Note that the image data used for toner consumption includes image data for each of a toner image formed on paper and a toner image formed on a belt. The toner image formed on paper corresponds to a first toner image, while the toner image formed on a belt corresponds to a second toner image.

A toner consumption patch can be created by a certain computational method to be described.

Toner consumption may be performed by an operation command of a user given through the operation display section or may be determined to be performed or not on the basis of a state of toner consumption. The state of toner consumption can be determined on the basis of whether certain concentration of toner is contained in a developing unit, for example.

Concentration control on the toner consumption patch will now be described. The control is performed by the control CPU 113.

Four colors including YMCK can be applied for a single pixel in the toner consumption patch where, when all colors have the concentration of 100%, toner may not be fixed completely and come off in some cases. When an image is output to the continuous paper in particular, there is no spacing between sheets of paper that is present on a cut sheet so that fixing temperature tends to be largely decreased and that it is better to avoid all colors having the concentration of 100%.

Here, a component requiring the toner consumption patch is a component that has low concentration among YMCK in image data, whereby the toner consumption patch is output with priority given to the component having low concentration in an output image. Specifically, with Dmin denoting the minimum toner concentration required by the developing unit and Dmax denoting the total maximum concentration (%) of all components including YMCK in the toner consumption patch, patch concentration can be found by a computational expression below. Here, Lx denotes insufficient concentration of a component x, and Px denotes concentration of the component x in the toner consumption patch. I denotes a toner consumption amount.

[Equation 1]

$$L_Y = \begin{cases} D_{min} & -I_Y I_Y < D_{min} \\ 0 & \text{else} \end{cases}$$

$$L_M = \begin{cases} D_{min} & -I_M I_M < D_{min} \\ 0 & \text{else} \end{cases}$$

$$L_C = \begin{cases} D_{min} & -I_C I_C < D_{min} \\ 0 & \text{else} \end{cases}$$

$$L_K = \begin{cases} D_{min} & -I_K I_K < D_{min} \\ 0 & \text{else} \end{cases}$$

$$P_Y = \frac{D_{max} L_Y}{L_Y + L_M + L_C + L_K}$$

$$P_M = \frac{D_{max} L_M}{L_Y + L_M + L_C + L_K}$$

$$P_C = \frac{D_{max} L_C}{L_Y + L_M + L_C + L_K}$$

-continued $$P_K = \frac{D_{max} L_K}{L_Y + L_M + L_C + L_K}$$

The control unit can select whether the toner consumption is to be performed on paper or a belt in performing toner consumption, where the selection may be made automatically under a predetermined condition or may be instructed by a user operation through the operation display section.

Control to perform the toner consumption on paper corresponds to first control, while control to perform the toner consumption on a belt corresponds to second control, each control being performed by the control unit.

The predetermined condition is stored beforehand in the non-volatile memory 115 or the HDD 119 and can be read at a proper timing by the control unit. The predetermined condition may be set by a default setting or may be set and changed by a user through the operation display section. The predetermined condition by which the selection is made may be presence or absence of a next job. It can be selected to perform the toner consumption on paper when there exists a next job to be performed sequentially, or to perform the toner consumption on a belt when there exists no next job to be performed sequentially, for example.

The next job may be performed before performing the toner consumption when there exists the next job with no predetermined time interval until the start of the next job or, when the predetermined time interval is secured until the start of the next job, the first control may be selected as needed to perform the toner consumption before performing the next job. The predetermined time interval can be stored beforehand in the non-volatile memory 115 or the HDD 119.

Moreover, when there exists the next job, it may be determined whether or not it is necessary to perform the toner consumption on the basis of the nature of the next job and may be determined to perform the toner consumption by the first control as needed. The nature of the next job can be a degree of urgency. An urgent job includes an interrupt job, whereas a non-urgent job includes a next job with ample time before the start of the job.

When paper runs out while the toner consumption is performed on paper, the toner consumption can be continued by switching control to perform the toner consumption on a belt. Moreover, when a job that can be performed immediately is generated while the toner consumption is performed on a belt, the toner consumption can be switched to be performed on paper to finish the operation in a short time and perform the job early.

FIGS. 3A to 3D are diagrams each illustrating an example of a first pattern to be the first toner image or a second pattern to be the second toner image.

Figure 3A:
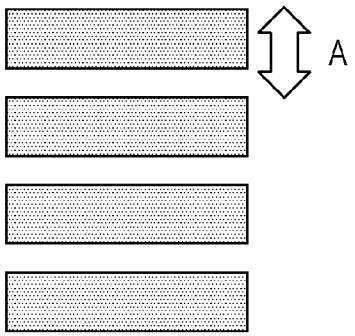
FIGS. 3A to 3D are diagrams each illustrating an example of a toner image used in toner consumption according to an embodiment of the present invention.
Figure 3B:
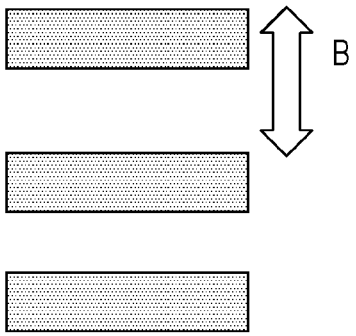

FIG. 3A illustrates a pattern that is formed on paper and allows toner to be consumed quickly with a small interval A between individual toner images. On the other hand, FIG. 3B illustrates a pattern that is formed on a belt. An individual toner image is identical to the individual toner image of the first pattern, but an interval B between the individual toner images is increased to reduce the toner consumption amount. Therefore, when forming the same amount of consumption patch, the consumption patch is formed B/A times faster with the first pattern than with the second pattern.

Figure 3C:
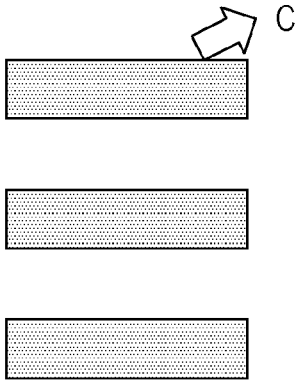
Figure 3D:
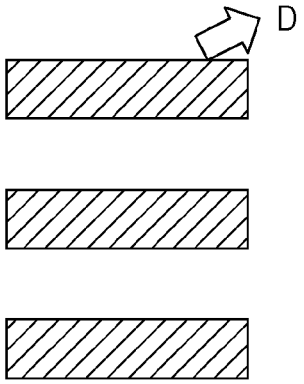

FIGS. 3C and 3D illustrate patterns having the individual toner image of the same size and the same interval between the individual toner images, but different toner concentration of the toner images. When C equals the toner concentration of the individual toner image of the first pattern in FIGS. 3C and D equals the toner concentration of the individual toner image of the second pattern in FIG. 3D, the same amount of consumption patch is formed C/D times faster with the first pattern than with the second pattern.

A pattern can also be set by combining the aforementioned patterns. The first pattern in FIG. 3A and the second pattern in FIG. 3D can be combined, for example.

Note that the pattern of each of the first toner image and the second toner image can be set as appropriate and is not limited to a particular pattern in the present invention. The shape, arrangement method, arrangement interval, the number of images arranged, and toner concentration of the toner image can be set as appropriate, for example.

Figure 4:
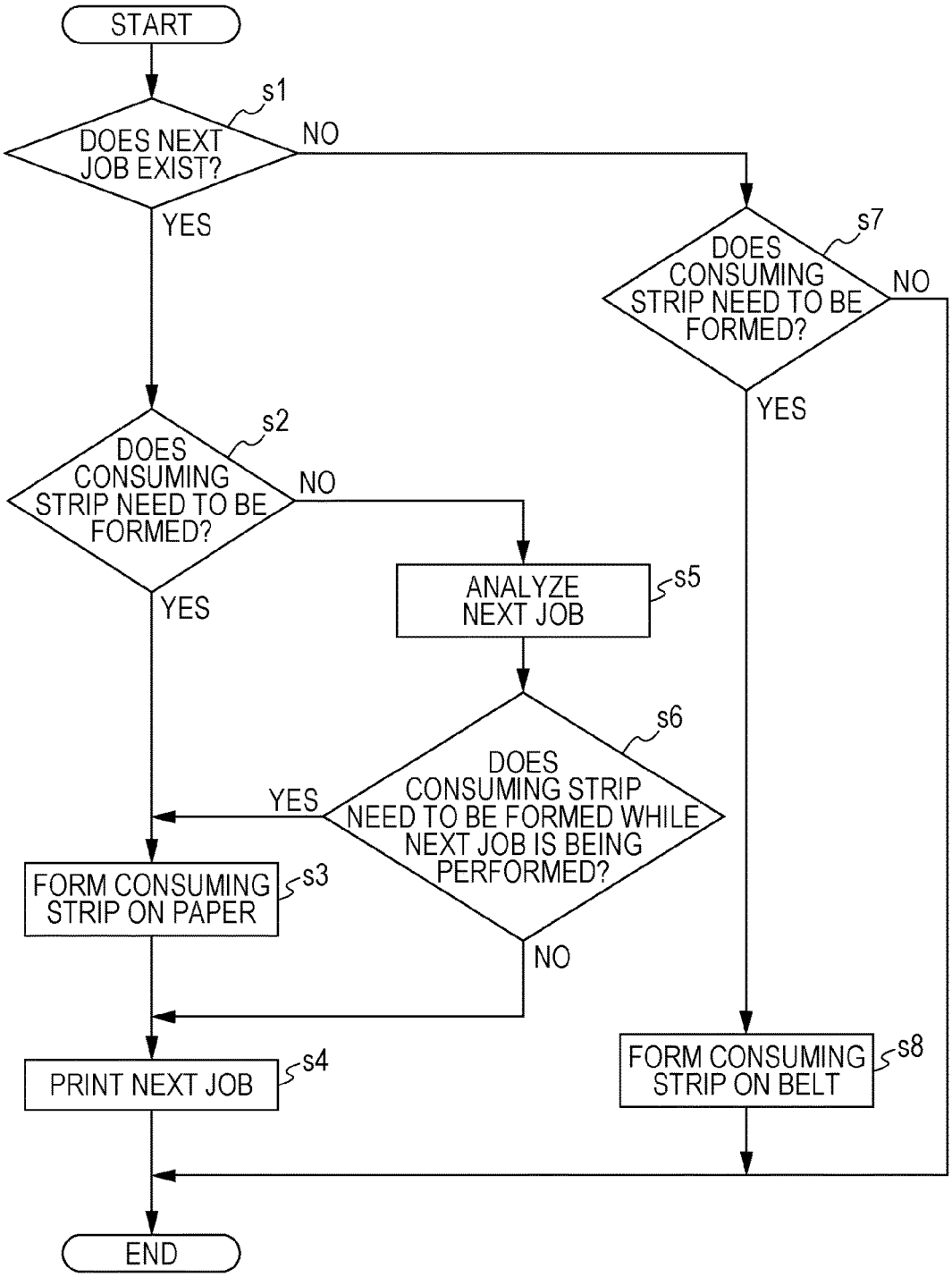
FIG. 4 is a flowchart illustrating a procedure of changing where a toner consuming strip is formed according to a timing at which a next job is performed, according to an embodiment of the present invention.

Next, a procedure of changing where to form a consuming strip according to a timing at which a next job is performed will be described with reference to a flowchart in FIG. 4. Note that the procedure in the flowchart below is performed under control of the control unit.

First, the image forming apparatus 1 checks whether there exists a next job (step s1). The next job can be determined to exist when the next job is a job to be performed sequentially.

When the next job does not exist (No in step s1), it is determined whether a consuming strip needs to be formed (toner consumption control needs to be performed) (step s7). It can be determined whether the consuming strip needs to be formed according to a state of toner consumption such as whether certain concentration of toner is contained in the developing unit.

When it is determined that the consuming strip needs to be formed (Yes in step s7), the second control is performed to select formation of the consuming strip on a belt and form the consuming strip according to setting (step s8). The processing ends thereafter. The procedure also ends when it is determined that the consuming strip need not be formed (No in step s7).

When the next job is determined to exist in step s1 (Yes in step s1), on the other hand, it is determined whether a consuming strip needs to be formed (step s2). The determination can be made in a manner similar to that in step s7.

When it is determined that the consuming strip needs to be formed (Yes in step s2), the first control is performed to select formation of the consuming strip on paper and form the consuming strip according to setting (step s3). The next job is then printed (step s4) to end the procedure thereafter.

The next job is analyzed (step s5) when it is determined that the consuming strip need not be formed (No in step s2). The time it takes for the job to be completed is analyzed, for example.

It is then determined according to a result of the analysis whether the consuming strip needs to be formed while the next job is being performed (steps 6). The determination can be made in a manner similar to that in step s2.

When it is determined that the consuming strip needs to be formed while the next job is being performed (Yes in step s6), the procedure proceeds to step s3 to select and perform formation of the consuming strip on paper before performing the next job, and then the next job is performed. The procedure proceeds to step s4 to perform the next job when it is determined that the consuming strip need not be formed while the next job is being performed (No in step s6).

Next, a procedure pertaining to processing performed while the consuming strip is being formed will be described on the basis of a flowchart in each of FIGS. 5 and 6, the procedure being described separately for a case (the flowchart in FIG. 5) where the consuming strip is formed on paper and a case (the flowchart in FIG. 6) where the consuming strip is formed on a belt. Note that the procedure in the flowchart below is performed under control of the control unit.

Figure 5:
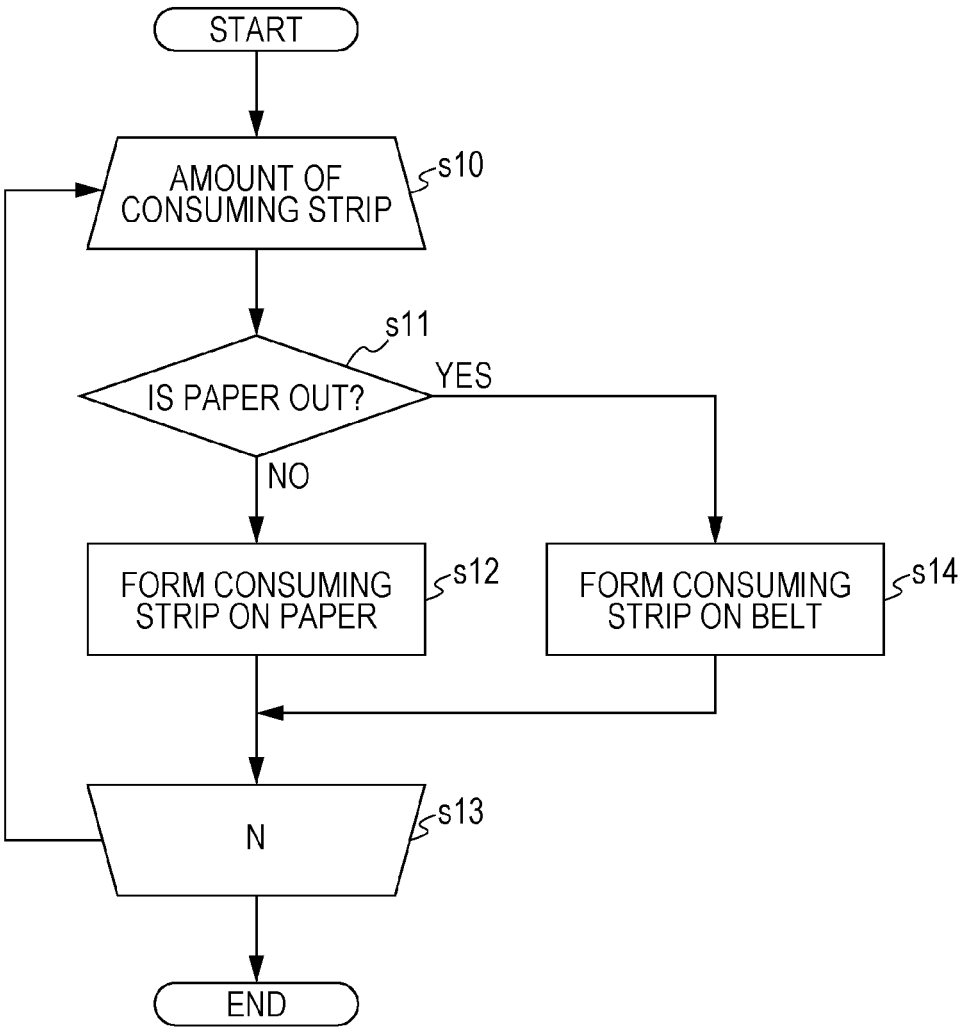
FIG. 5 is a flowchart illustrating a procedure of changing where the toner consuming strip is formed according to presence or absence of paper while toner consumption is being performed, according to an embodiment of the present invention.

Different procedures are performed depending on presence/absence of paper, according to the flowchart in FIG. 5.

It is assumed that the consuming strip is formed for N pages of paper. The amount of the consuming strip formed is set by the control unit.

A loop is executed (step s10) in response to a page increment (default: 1).

First, it is determined whether paper is out (step s11). It is checked whether paper is out at all times when the consuming strip is being formed on paper.

When it is not out of paper (No in step s11), the first control is performed to form the consuming strip on paper according to setting (step s12).

When it is out of paper (Yes in step s11), the second control is performed to form the consuming strip on a belt according to setting (step s14). This is because the consuming strip cannot be formed on paper when paper runs out while the consuming strip is being formed so that, from then on, the consuming strip is formed on a belt as described above.

After the consuming strip is formed (steps s12 and s14), the procedure is repeated until the number of pages reaches N (step s13). The processing ends once the number of pages reaches N.

Figure 6:
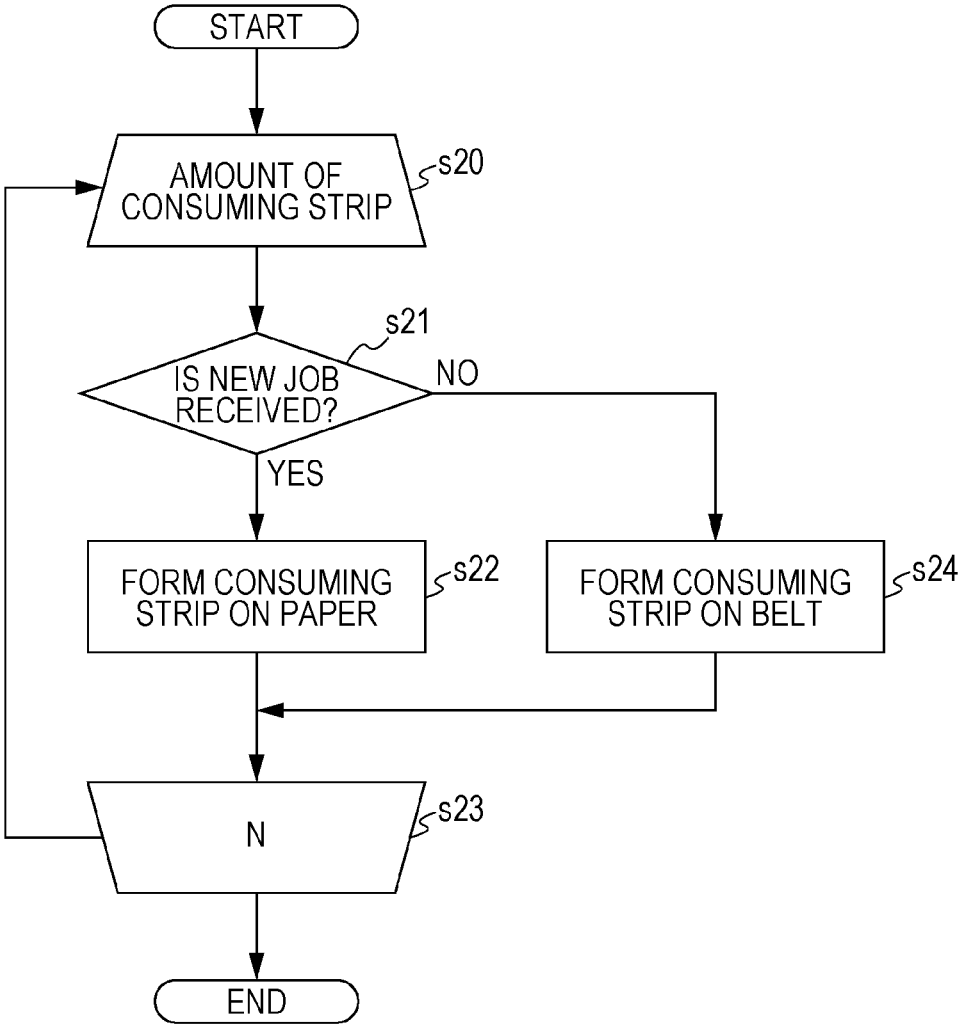
FIG. 6 is a flowchart illustrating a procedure of changing where the toner consuming strip is formed according to presence or absence of a new job while toner consumption is being performed, according to an embodiment of the present invention.

Different procedures are performed depending on presence/absence of a new job, according to the flowchart in FIG. 6. It is checked whether a new job is input while the consuming strip is being formed on a belt. When the new job is received, the consuming strip from then on is formed on paper according to the first control in order to shorten time until the job is started.

Specific description will be provided below.

It is also assumed in this procedure that the consuming strip is formed for N pages of paper (step s20).

First, it is determined whether a new job is received (step s21). The new job may be a job that can be performed immediately or within a predetermined time. The predetermined time can be set by the control unit.

When the new job is not received (No in step s21), the second control is performed to form the consuming strip on a belt according to setting (step s24). When the new job is received (Yes in step s21), the first control is performed to form the consuming strip on paper according to setting (step s22).

After the consuming strip is formed (steps s22 and s24), the procedure is repeated until the number of pages reaches N (step s23). The processing ends once the number of pages reaches N.

Figure 7:
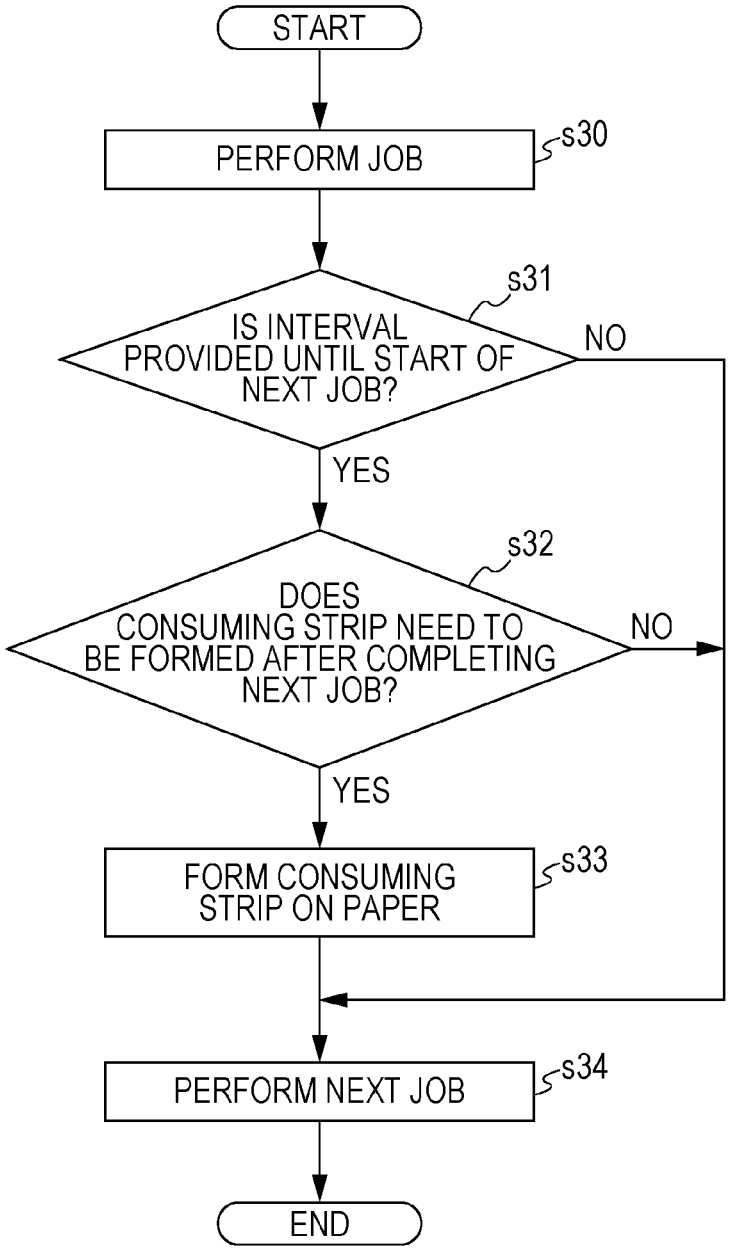
FIG. 7 is a flowchart illustrating a procedure of setting timing to perform toner consumption according to an interval until a next job, according to an embodiment of the present invention.

Next, a flowchart in FIG. 7 will be used to describe a procedure of forming a consuming strip in advance when a job cannot be performed sequentially due to setting on sequential print/copy that is turned off. Note that the procedure in the flowchart below is performed under control of the control unit.

There occurs a delay between jobs when the apparatus is operated in a mode in which a job cannot be performed sequentially by setting, in which case a part of the consuming strip is formed at a timing a job is delayed when the consuming strip is to be formed after performing a next job.

The consuming strip is formed on paper that continues to be conveyed while the job is delayed.

Specific description will be provided below.

A job is performed (step s30), then it is determined whether a predetermined interval is provided until a next job (step s31). The predetermined interval can be set in advance by the control unit. Alternatively, a user may indicate whether or not the interval is provided through the operation display section.

When the predetermined interval is not provided until the start of the next job (No in step s31), the next job is performed (step s34) to end the processing thereafter.

When the predetermined interval is provided until the start of the next job (Yes in step s31), it is determined whether the consuming strip needs to be formed after completing the next job (step s32). The determination can be made by analyzing the next job and estimating time required for the job to be completed, for example.

When the consuming strip need not be formed after completing the next job (No in step s32), the next job is performed (step s34) to end the processing thereafter.

When it is determined that the consuming strip needs to be formed after completing the next job (Yes in step s32), the first control is performed to form the consuming strip on paper according to setting (step s33), then the next job is performed (step s34) to end the processing thereafter.

Note that while each of the aforementioned flowcharts is structured to automatically determine where to form the consuming strip, it may also be adapted to switch where to form the consuming strip by a user operation.

Although the embodiments of the invention have been described, various changes can be made without departing from the scope of the invention.

According to one or more embodiments of the invention, the toner image provided for toner consumption can be switchably formed on paper or a belt to be able to perform proper toner consumption control according to the job status or the like.

Although embodiments of the invention have been described and illustrated in detail, it is clearly understood that the same is by way of illustrated and example only and is not to be taken by way of limitation, the scope of the invention being interpreted by terms of the appended claims.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus that performs printing on continuous paper, the apparatus comprising:

an image forming unit that forms a toner image on an image carrier;

a transfer unit that transfers the toner image on the image carrier to the continuous paper;

a cleaning unit that removes a toner on a surface of the image carrier downstream of a transfer position; and a control unit that performs toner consumption control to form the toner image on the image carrier, wherein the control unit performs, in the toner consumption control, a first control that forms a first toner image on the image carrier and transfers the first toner image to the continuous paper and a second control that forms a second toner image on the image carrier and removes the toner by the cleaning unit without transferring the second toner image to the continuous paper, and the control unit selects the first control when a next job to be performed sequentially exists, and selects the second control when the next job to be performed sequentially does not exist.

2. The image forming apparatus according to claim 1, wherein the control unit in the second control forms, on the image carrier, the second toner image in which an amount of toner is restricted more than the first toner image.

3. The image forming apparatus according to claim 1, wherein, when no predetermined time interval is provided until the start of the next job, the control unit performs the next job before performing the toner consumption control.

4. The image forming apparatus according to claim 1, wherein, when a predetermined time interval is provided until the start of the next job, the control unit selects the first control as needed and performs the toner consumption control before performing the next job.

5. The image forming apparatus according to claim 1, wherein, when the toner consumption control is not needed in the next job to be performed sequentially, the control unit analyzes a following job to be performed after the next job, and when the toner consumption control is needed while the following job is being performed, the control unit performs the toner consumption control by the first control before performing the following job.

6. The image forming apparatus according to claim 1, wherein, when the continuous paper runs out while the toner consumption control is being performed by the first control, the control unit switches the first control to the second control and continues the toner consumption control.

7. The image forming apparatus according to claim 1, wherein, when the next job that can be performed is generated while the toner consumption control is being performed by the second control, the control unit switches the second control to the first control and continues the toner consumption control.

8. The image forming apparatus according to claim 1, further comprising an operation display section that receives operational input, wherein the control unit receives an instruction of a user through the operation display section and selects either the first control or the second control in the toner consumption control.

9. The image forming apparatus according to claim 1, wherein the control unit determines whether or not the toner consumption control needs to be performed on a basis of a state of toner consumption and, when determining that the toner consumption control is needed, performs the toner consumption control by the first control or the second control.

10. The image forming apparatus according to claim 1, wherein, the control unit determines whether or not the toner consumption control needs to be performed on a basis of a nature of the next job and performs the toner consumption control by the first control when determining that the toner consumption control is needed.

11. The image forming apparatus according to claim 1, wherein the cleaning unit includes a mechanism that removes toner with a blade pressed against the image carrier.

12. The image forming apparatus according to claim 1, wherein the image carrier is one or both of an intermediate transfer unit and a photoreceptor.

13. The image forming apparatus according to claim 1, wherein the control unit performs the toner consumption control while no job is being performed.

14. An image forming system comprising an image forming apparatus according to claim 1.

15. An image forming method that forms an image on continuous paper, the method comprising:

a process of performing a toner consumption control in which a toner image is formed on an image carrier; and a selection process of selecting and operating either a first control process of forming a first toner image on the image carrier and transferring the first toner image to the continuous paper, or a second control process of forming a second toner image on the image carrier and removing a toner by a cleaning unit without transferring the second toner image to the continuous paper, wherein when a next job to be performed sequentially exists, the first control process is selected in the selection process, and when the next job to be performed sequentially does not exist, the second control process is selected in the selection process.

16. An image forming apparatus that performs printing on continuous paper, the apparatus comprising:

an image forming unit that forms a toner image on an image carrier;

a transfer unit that transfers the toner image on the image carrier to the continuous paper;

a cleaning unit that removes a toner on a surface of the image carrier downstream of a transfer position; and a control unit that performs toner consumption control to form the toner image on the image carrier, wherein the control unit performs, in the toner consumption control, a first control that forms a first toner image on the image carrier and transfers the first toner image to the continuous paper and a second control that forms a second toner image on the image carrier and removes the toner by the cleaning unit without transferring the second toner image to the continuous paper, the control unit selects one of the first control or the second control to be operated, and when the continuous paper runs out while the toner consumption control is being performed by the first control, the control unit switches the first control to the second control and continues the toner consumption control, or when a next executable job is generated while the toner consumption control is being performed by the second control, the control unit switches the second control to the first control and continues the toner consumption control.

* * * * *